US008959961B2

(12) United States Patent
Jenkins et al.

(10) Patent No.: US 8,959,961 B2
(45) Date of Patent: Feb. 24, 2015

(54) CLEANING APPARATUS FOR SOILED SUBSTRATES HAVING A REMOVABLE CAGE SEALING MEANS

(75) Inventors: Stephen Derek Jenkins, Middlesbrough (GB); William George Westwater, Sheffield (GB)

(73) Assignee: Xeros Limited, Leeds, Yorkshire (GB)

( * ) Notice: Subject to any disclaimer, the term of this patent is extended or adjusted under 35 U.S.C. 154(b) by 216 days.

(21) Appl. No.: 13/511,518

(22) PCT Filed: Nov. 24, 2010

(86) PCT No.: PCT/GB2010/051960

§ 371 (c)(1),
(2), (4) Date: May 23, 2012

(87) PCT Pub. No.: WO2011/064581

PCT Pub. Date: Jun. 3, 2011

(65) Prior Publication Data

US 2012/0284931 A1 Nov. 15, 2012

(30) Foreign Application Priority Data

Nov. 24, 2009 (GB) ..... 0920565.9

(51) Int. Cl.
*D06F 23/02* (2006.01)
*D06F 35/00* (2006.01)

(52) U.S. Cl.
CPC ..... *D06F 23/025* (2013.01); *D06F 35/00* (2013.01); *D06F 35/006* (2013.01)
USPC ..... 68/3 R

(58) Field of Classification Search
CPC ..... D06F 23/02; D06F 23/025
USPC ..... 68/3 R
See application file for complete search history.

(56) References Cited

U.S. PATENT DOCUMENTS

| | | | | |
|---|---|---|---|---|
| 5,093,948 | A | 3/1992 | Val et al. | |
| 6,343,492 | B1 * | 2/2002 | Seagar et al. | 68/142 |
| 2004/0007028 | A1 | 1/2004 | Panther et al. | |
| 2004/0231062 | A1 * | 11/2004 | Sharrow | 8/158 |
| 2005/0120758 | A1 * | 6/2005 | Thies et al. | 68/18 R |
| 2005/0183208 | A1 | 8/2005 | Scheper et al. | |

FOREIGN PATENT DOCUMENTS

| | | |
|---|---|---|
| GB | 2364716 A | 2/2002 |
| JP | 2005532113 | 10/2005 |
| JP | 2007521931 | 8/2007 |

* cited by examiner

*Primary Examiner* — Michael Barr
*Assistant Examiner* — Spencer Bell
(74) *Attorney, Agent, or Firm* — Ward and Smith, P.A.

(57) ABSTRACT

The invention provides an apparatus and method for use in the cleaning of soiled substrates, the apparatus comprising: (a) housing means, having: (i) a first upper chamber having mounted therein a rotatably mounted cylindrical cage, and (ii) a second lower chamber located beneath said cylindrical cage; (b) at least one recirculation means; (c) access means; (d) a multiplicity of delivery means; and (e) sealing means, wherein said sealing means is removably attached to the outer surface of the cylindrical side walls of said rotatably mounted cylindrical cage, and is adapted to prevent the ingress or egress of fluids and solid particulate matter from the interior of said cage. The method involves cleaning the soiled substrate by treatment of the substrate with a formulation comprising solid particulate cleaning material and wash water, the method being carried out using the apparatus of the invention, and the apparatus and method find particular application in the cleaning of textile fabrics.

20 Claims, 9 Drawing Sheets

System Configuration

Leading edge of skin extended towards drum

Leading edge of skin engaged with drum

Drum rotates and pulls skin on to drum surface

Drums continues to rotate

Trailing edge of skin reaches drum

Trailing edge of skin engaged with drum to keep skin in place

Trailing edge of skin released from drum

Trailing edge of skin engaged with rewind mechanism

Drum rotates and skin is rewound

Drum continues to rotate as skin is rewound

Leading edge of skin is released from drum

Skin is fully retracted clear of drum

UNCLEANED XEROS STANDARD STAIN SET AND SEBUM CLOTH

L* DATA BY STAIN TYPE

L* DATA AVERAGED OVER ALL STAINS

CLEANING APPARATUS FOR SOILED SUBSTRATES HAVING A REMOVABLE CAGE SEALING MEANS

FIELD OF THE INVENTION

The present invention relates to the aqueous cleaning of substrates using a cleaning system which requires the use of only limited quantities of energy, water and detergent. Most particularly, the invention is concerned with the cleaning of textile fibres and fabrics by means of such a system, and provides an apparatus adapted for use in this context.

BACKGROUND TO THE INVENTION

Aqueous cleaning processes are a mainstay of both domestic and industrial textile fabric washing. On the assumption that the desired level of cleaning is achieved, the efficacy of such processes is usually characterised by their levels of consumption of energy, water and detergent. In general, the lower the requirements with regard to these three components, the more efficient the washing process is deemed. The downstream effect of reduced water and detergent consumption is also significant, as this minimises the need for disposal of aqueous effluent, which is both extremely costly and detrimental to the environment.

Such washing processes involve aqueous submersion of fabrics followed by soil removal, aqueous soil suspension, and water rinsing. In general, the higher the level of energy (or temperature), water and detergent which is used, the better the cleaning. The key issue, however, concerns water consumption, as this sets the energy requirements (in order to heat the wash water), and the detergent dosage (to achieve the desired detergent concentration). In addition, the water usage level defines the mechanical action of the process on the fabric, which is another important performance parameter; this is the agitation of the cloth surface during washing, which plays a key role in releasing embedded soil. In aqueous processes, such mechanical action is provided by the water usage level in combination with the drum design for any particular washing machine. In general terms, it is found that the higher the water level in the drum, the better the mechanical action. Hence, there is a dichotomy created by the desire to improve overall process efficiency (i.e. reduce energy, water and detergent consumption), and the need for efficient mechanical action in the wash. For domestic washing in particular there are defined wash performance standards specifically designed to discourage the use of such higher levels in practice, in addition to the obvious cost penalties which are associated with such usage.

Current efficient domestic washing machines have made significant strides towards minimising their consumptions of energy, water and detergent. EU Directive 92/75/CEE sets a standard which defines washing machine energy consumption in kWh/cycle (cotton setting at 60° C.), such that an efficient domestic washing machine will typically consume <0.19 kWh/kg of washload in order to obtain an 'A' rating. If water consumption is also considered, then 'A' rated machines use <9.7 liters/kg of washload, whilst the most efficient modern machines are now capable of using even less water—e.g. model number F1480FD6 manufactured by LG (see www.lg.com). This machine typically uses 63 liters/kg for a 9 kg washload, i.e. 7 liters/kg.

Detergent dosage is then driven by manufacturer recommendations but, again, in the domestic market, for a concentrated liquid formulation, a figure of 35 ml (or 37 g) for a 4-6 kg washload in soft and medium hardness water, increasing to 52 ml (or 55 g) for a 6-8 kg washload (or in hard water or for very dirty items) is typical (see, for example, UNILEVER pack dosage instructions for PERSIL® SMALL & MIGHTY). Hence, for a 4-6 kg washload in soft/medium water hardness, this equates to a detergent dosage of 7.4-9.2 g/kg whilst, for a 6-8 kg washload (or in hard Water or for very dirty items), the range is 6.9-9.2 g/kg.

Energy, water and detergent consumptions in the industrial washing process (washer-extractors) are considerably different, however, and usages of energy and water are less constrained in such environments, since these are principal factors in reducing cycle time—which is, of course, more of a consideration than in the domestic scenario. There is a similar pressure on detergent levels, however, but this is mostly due to a desire to reduce cost.

Thus, it can be taken from the above discussion that the performance levels which set the highest standard for an efficient fabric washing process are an energy consumption of <0.19 kWh/kg, a water usage of approximately 7 liters/kg, and a detergent dosage of approximately 8 g/kg. However, as already mentioned, it is becoming increasingly difficult to reduce the water (and, hence, energy and detergent) levels in a purely aqueous process, due to the minimum requirement to wet the fabric thoroughly, the need to provide sufficient excess water to suspend the soil removed in an aqueous liquor and, finally, the need to rinse the fabric.

Heating of the wash water is then the principal use of energy, and a minimum level of detergent becomes necessary in order for an effective concentration to be reached at the operating wash temperature. If a means to improve mechanical action could be achieved without increasing the water level used, then the aqueous wash process could become significantly more efficient (i.e. yield further reductions in energy, water and detergent consumption). It should be noted that mechanical action itself has a direct effect on the detergent level, since the greater the level of soil removal which is achieved through physical force, the less that is required of the detergent chemistry. However, increasing the mechanical action in a purely aqueous washing process has certain associated drawbacks. Fabric creasing readily occurs in such processes, and this acts to concentrate the stresses from mechanical action at each crease, resulting in localised fabric damage. Prevention of such fabric damage (i.e. fabric care) is of primary concern to the domestic consumer and the industrial user.

Various different approaches to the development of new cleaning technologies have been reported in the prior art, including methods which rely on electrolytic cleaning or plasma cleaning, in addition to approaches which are based on ozone technology, ultrasonic technology or steam technology. Thus, for example, WO-A-2009/021919 teaches a fabric cleaning and disinfection process which utilises UV-produced ozone along with plasma. An alternative technology involves cold water washing in the presence of specified enzymes, whilst a further approach which is particularly favoured relies on air-wash technology and, for example, is disclosed in US-A-2009/0090138. In addition, various carbon dioxide cleaning technologies have been developed, such as the methods using ester additives and dense phase gas treatments which are described in U.S. Pat. No. 7,481,893 and US-A-2008/0223406, although such methods generally find greater applicability in the field of dry cleaning. Many of these technologies are, however, technically complex and not readily suited to domestic applications, in particular.

In the light of the challenges which are associated with aqueous washing processes, the present inventors have previously devised a new approach to the problem, which is technologically straightforward, and yet still allows the deficiencies demonstrated by the methods of the prior art to be overcome. The method which is provided eliminates the requirement for the use of large volumes of water, but is still capable of providing an efficient means of cleaning and stain removal, whilst also yielding economic and environmental benefits.

Thus, in WO-A-2007/128962 there is disclosed a method and formulation for cleaning a soiled substrate, the method comprising the treatment of the moistened substrate with a formulation comprising a multiplicity of polymeric particles, wherein the formulation is free of organic solvents. Preferably, the substrate is wetted so as to achieve a substrate to water ratio of between 1:0.1 to 1:5 w/w, and optionally, the formulation additionally comprises at least one cleaning material, which typically comprises a surfactant, which most preferably has detergent properties. In preferred embodiments, the substrate comprises a textile fibre and the polymeric particles may, for example, comprise particles of polyamides, polyesters, polyalkenes, polyurethanes or their copolymers, but are most preferably in the form of nylon chips.

The use of this cleaning method, however, presents a requirement for the cleaning chips or beads to be efficiently separated from the cleaned substrate at the conclusion of the cleaning operation, and this issue was initially addressed in WO-A-2010/094959, which provides a novel design of cleaning apparatus requiring the use of two internal drums capable of independent rotation, and which finds application in both industrial and domestic cleaning processes. With a view to providing a simpler, more economical means for addressing the problem of efficient separation of the cleaning media from the substrate at the conclusion of the cleaning process, however, the present inventors have now developed the apparatus herein disclosed, which provides a novel design requiring the use of a perforated drum and a removable outer drum skin, and which finds application in both industrial and domestic cleaning processes.

SUMMARY OF THE INVENTION

Thus, according to a first aspect of the present invention, there is provided an apparatus for use in the cleaning of soiled substrates, said apparatus comprising:

(a) housing means, having:
  (i) a first upper chamber having mounted therein a rotatably mounted cylindrical cage, and
  (ii) a second lower chamber located beneath said cylindrical cage;
(b) at least one recirculation means;
(c) access means;
(d) a multiplicity of delivery means; and
(e) sealing means, wherein said sealing means is removably attached to the outer surface of the cylindrical side walls of said rotatably mounted cylindrical cage, and is adapted to prevent the ingress or egress of fluids and solid particulate matter from the interior of said cage.

Said access means typically comprises a hinged door mounted in the casing, which may be opened to allow access to the inside of the cylindrical cage, and which may be closed in order to provide a substantially sealed system. Preferably, the door includes a window.

In preferred embodiments of the invention, said rotatably mounted cylindrical cage is in the form of a perforated drum. Said rotatably mounted cylindrical cage may be mounted vertically within said housing means but, most preferably, is mounted horizontally within said housing means. Consequently, in preferred embodiments of the invention, said access means is located in the front of the apparatus, providing a front-loading facility. When the rotatably mounted cylindrical cage is vertically mounted within the housing means, the access means is located in the top of the apparatus, providing a top-loading facility. However, for the purposes of the further description of the present invention, it will be assumed that said rotatably mounted cylindrical cage is mounted horizontally within said housing means.

Rotation of said rotatably mounted cylindrical cage is effected by use of drive means, which typically comprises electrical drive means, in the form of an electric motor. Operation of said drive means is effected by control means which may be programmed by an operative.

Said rotatably mounted cylindrical cage comprises a plurality of perforations in its cylindrical side walls, thereby allowing for ingress and egress of fluids and, in the absence of said sealing means, fine particulate materials and discrete particulate materials. Said perforations typically have a diameter of from 2 to 25 mm, preferably from 4 to 10 mm, most preferably from 5 to 8 mm.

Said rotatably mounted cylindrical cage is of the size which is to be found in most industrial or domestic washing machines, and may have a capacity in the region of 10 to 7000 liters. A typical capacity for a domestic washing machine would be in the region of 30 to 120 liters, and for an industrial washer-extractor anything from 120-7000 liters is possible. A common size in this range is that which is suitable for a 50 kg washload, wherein the drum has a volume of 450 to 650 liters and, in such cases, the cage would generally comprise a cylinder with a diameter in the region of 75 to 120 cm, preferably from 90 to 110 cm, and a length of between 40 and 100 cm, preferably between 60 and 90 cm. In general, the cage will have 10 liters of volume per kg of washload to be cleaned.

Said apparatus is designed to operate in conjunction with soiled substrates and cleaning media comprising a solid particulate material, which is most preferably in the form of a multiplicity of polymeric particles. Ideally, these polymeric particles should be efficiently circulated to promote effective cleaning and the apparatus, therefore, preferably includes circulation means. Thus, the inner surface of the cylindrical side walls of said rotatably mounted cylindrical cage preferably comprises a multiplicity of spaced apart elongated protrusions affixed essentially perpendicularly to said inner surface. Preferably, said protrusions additionally comprise air amplifiers which are typically driven pneumatically and are adapted so as to promote circulation of a current of air within said cage. Typically said apparatus comprises from 3 to 10, most preferably 4, of said protrusions, which are commonly referred to as lifters.

In operation, agitation is provided by rotation of said rotatably mounted cylindrical cage. However, in preferred embodiments of the invention, there is also provided additional agitating means, in order to facilitate the efficient removal of residual solid particulate material at the conclusion of the cleaning operation. Preferably, said agitating means comprises an air jet.

Said rotatably mounted cylindrical cage is located within a first upper chamber of said housing means and beneath said first upper chamber is located a second lower chamber which functions as a collection chamber for said cleaning media. Preferably, said lower chamber comprises an enlarged sump.

Said housing means is connected to standard plumbing features, thereby providing at least one recirculation means, in addition to a multiplicity of delivery means, by virtue of which at least water and, optionally, cleaning agents such as surfactants may be introduced into the apparatus. Said apparatus may additionally comprise means for circulating air within said housing means, and for adjusting the temperature and humidity therein. Said means may typically include, for example, a recirculating fan, an air heater, a water atomiser and/or a steam generator. Additionally, sensing means may also be provided for determining the temperature and humidity levels within the apparatus, and for communicating this information to the control means.

Thus, said apparatus comprises at least one recirculation means, thereby facilitating recirculation of said solid particulate material from said lower chamber to said rotatably mounted cylindrical cage, for re-use in cleaning operations. Preferably, said first recirculation means comprises ducting connecting said second chamber and said rotatably mounted cylindrical cage. More preferably, said ducting comprises separating means for separating said solid particulate material from water and control means, adapted to control entry of said solid particulate material into said cylindrical cage. Typically, said separating means comprises a filter material such as a wire mesh located above said cylindrical cage and said control means comprises a valve located in feeder means, preferably in the form of a feed tube attached to said receptor vessel and connected to the interior of the cylindrical cage.

Recirculation of solid particulate matter from said lower chamber to said rotatably mounted cylindrical cage is typically achieved by the use of pumping means comprised in said first recirculation means.

Preferably, said apparatus additionally includes a second recirculation means, allowing for the return of water separated by said separating means to said lower chamber, thereby facilitating re-use of said water in an environmentally beneficial manner.

Preferably, said lower chamber comprises additional pumping means to promote circulation and mixing of the contents thereof, in addition to heating means, allowing the contents to be raised to a preferred temperature of operation.

An essential feature of the presently claimed invention comprises sealing means, removably attached to the outer surface of the cylindrical side walls of the rotatably mounted cylindrical cage, and adapted to prevent the ingress or egress of fluids and solid particulate matter from the interior of said cage. Said sealing means preferably comprises a flexible polymeric sheet of material which, when affixed to the outer surface of said cylindrical cage, seals the cage to act as a washing drum. However, on removal of said sealing means from the outer surface of the cylindrical side walls of the rotatably mounted cylindrical cage, the washing fluids and solid particulate matter are free to exit the cage via the perforations in the side walls of said cage and, thereby, to fall into the lower chamber of said apparatus.

Typically, in preferred embodiments of the invention, said sealing means comprises a polymeric material such as nylon, preferably in the form of ripstop nylon, which is formed into a tear-resistant, woven sheet, and is attached to the outer surface of said cylindrical cage by fixing means such as hooks and/or tie bars and/or tensioning clips. In order to facilitate attachment and removal of said sealing means, said housing means preferably comprises an aperture which provides access to the outer surface of said cylindrical cage. Said sealing means may be attached and removed from the outer surface of said cage either manually or automatically. The invention also envisages attachment of said sealing means by vacuum means, wherein release and removal of the sealing means may be effected by removal of the vacuum.

In alternative embodiments of the invention, said sealing means may comprise covers which are attached slideably or via a hinged mechanism to the inner or outer surface of said cylindrical cage and may be moved from a first position, covering said perforations, to a second position, wherein said perforations are opened to allow ingress and egress of materials to and from said cylindrical cage.

In operation, during a typical cycle, the sealing means is attached to said rotatably mounted cylindrical cage, into which are placed soiled garments. The solid particulate material and the necessary amount of wash water, together with any required additional cleaning agent, are heated to the desired temperature in the lower chamber comprised in the housing means and introduced, via the first recirculation means, into the cylindrical cage. Following agitation by rotation of the cage, the sealing means is removed, allowing the fluids and solid particulate material to fall through the perforations in the cage and into the lower chamber of the apparatus.

In the event that it is necessary to reheat the solid particulate material during the cleaning process, then it may be recirculated via the first recirculation means such that it returns to the cylindrical cage, to which the sealing means is re-applied before re-entry of the material therein. Thus, after reheating in the lower chamber of the apparatus, the solid particulate material is carried to the top side of said rotatably mounted cylindrical cage, wherein it is caused, by means of gravity, to fall through said separation means and, by operation of control means, through said feeder means and back into said cage, thereby to continue the cleaning operation. In preferred embodiments of the invention, however, this reheating step is unnecessary and only one application of the sealing means is required.

Thus, according to a second aspect of the present invention, there is provided a method for cleaning a soiled substrate, said method comprising the treatment of the substrate with a formulation comprising solid particulate cleaning material and wash water, wherein said method is carried out in an apparatus according to the first aspect of the invention.

Preferably, said method comprises the steps of:

(a) attaching sealing means to the outer surface of a rotatably mounted cylindrical cage of an apparatus according to the first aspect of the invention;
(b) introducing a solid particulate cleaning material and wash water into the second lower chamber of said apparatus;
(c) agitating and heating said solid particulate cleaning material and water;
(d) loading at least one soiled substrate into said rotatably mounted cylindrical cage via access means;
(e) closing the access means so as to provide a substantially sealed system;
(f) introducing said solid particulate cleaning material and water into said rotatably mounted cylindrical cage via recirculating means;
(g) operating the apparatus for a first (wash) cycle, wherein said rotatably mounted cylindrical is caused to rotate;
(h) removing said sealing means from the outer surface of said rotatably mounted cylindrical cage;
(i) operating the apparatus for a second cycle, wherein fluids and solid particulate cleaning material are caused to fall through perforations in said rotatably mounted cylindrical cage into said second lower chamber;
(j) repeating steps (a), (c) and (f) to (i) as required; and
(k) removing the cleaned at least one substrate from the apparatus.

Optionally, the introduction of said solid particulate cleaning material and water in steps (b) and (f) of said method additionally comprises the introduction of at least one additional cleaning agent. Said at least one cleaning agent preferably comprises at least one detergent composition.

Optionally, said second cycle may additionally comprise a rinsing operation, wherein further water may be added to said rotatably mounted cylindrical cage. Optionally, said rinse cycle may be used for the purposes of substrate treatment, involving the addition of treatment agents such as fluorescent brighteners, perfumes, softeners and starch to the rinse water.

Optionally, the rotation speed of said rotatably mounted cylindrical cage may be increased during said second cycle.

Furthermore, said solid particulate cleaning material may optionally be subjected to a cleaning operation in said lower chamber by sluicing said chamber with clean water in the presence or absence of a cleaning agent, such as a surfactant. Alternatively, cleaning of the solid particulate cleaning material may be achieved as a separate stage in said rotatably mounted cylindrical cage.

Generally, any remaining solid particulate cleaning material on said at least one substrate may be easily removed by shaking the at least one substrate. If necessary, however, further remaining solid particulate cleaning material may be removed by suction means, preferably comprising a vacuum wand.

BRIEF DESCRIPTION OF THE DRAWINGS

The invention will now be further illustrated by reference to the following drawings, wherein:

FIG. 2(*b*) depicts the rotatably mounted cylindrical cage with the sealing means attached;

DETAILED DESCRIPTION OF THE INVENTION

Figure 1:
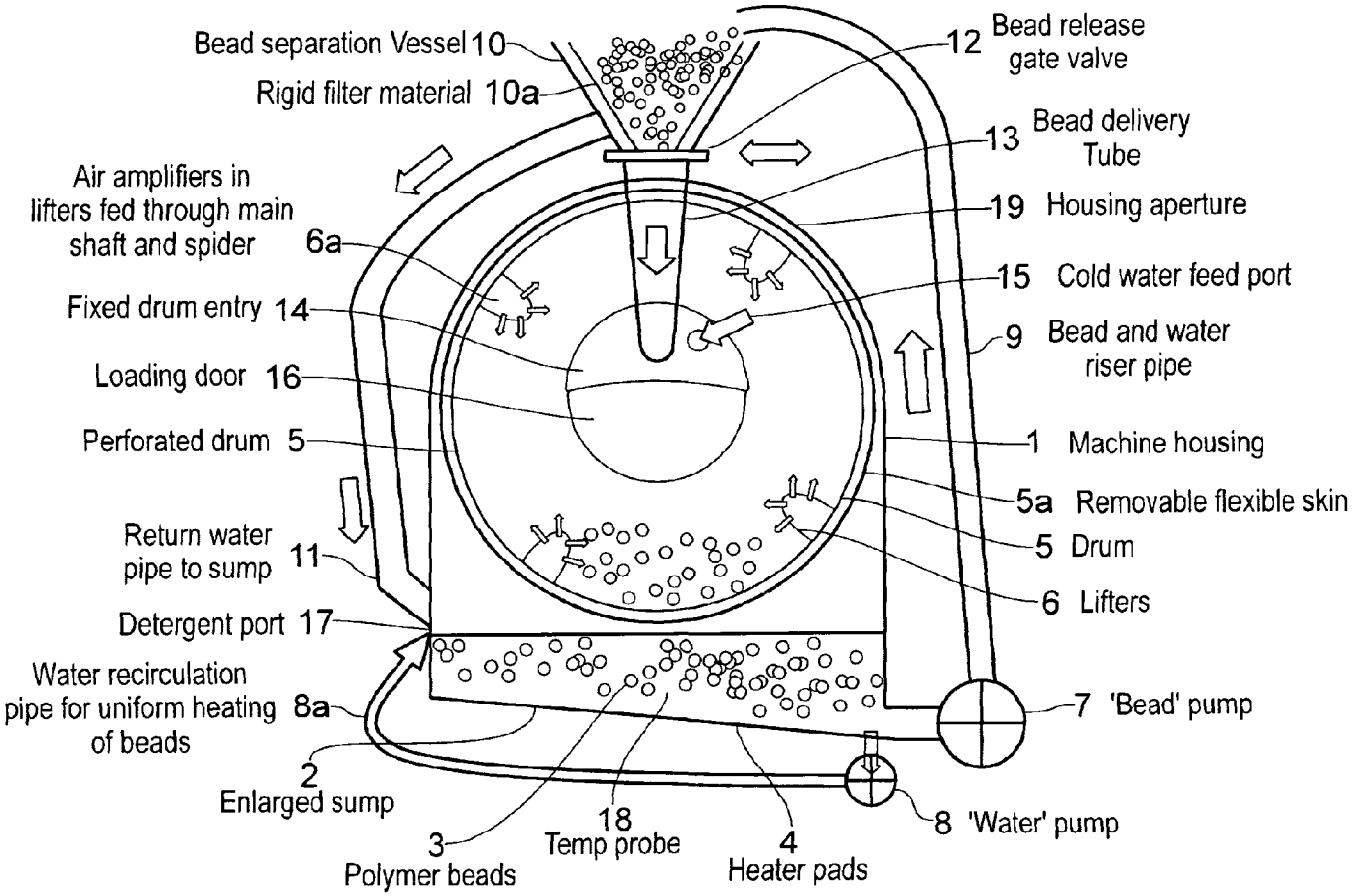
FIG. 1 shows a schematic diagram of the apparatus according to the invention.

The apparatus according to the invention may be used for the cleaning of any of a wide range of substrates including, for example, plastics materials, leather, paper, cardboard, metal, glass or wood. In practice, however, said apparatus is principally designed for use in the cleaning of substrates comprising textile fibre garments, and has been shown to be particularly successful in achieving efficient cleaning of textile fibres which may, for example, comprise either natural fibres, such as cotton, or man-made and synthetic textile fibres, for example nylon 6,6, polyester, cellulose acetate, or fibre blends thereof.

Most preferably, the solid particulate cleaning material comprises a multiplicity of polymeric particles. Typically, the polymeric particles comprise polyalkenes such as polyethylene and polypropylene, polyamides, polyesters or polyurethanes, which may be foamed or unfoamed. Furthermore, said polymers may be linear or crosslinked. Preferably, however, said polymeric particles comprise polyamide or polyester particles. Said polyamides and polyesters are found to be particularly effective for aqueous stain/soil removal, whilst polyalkenes are especially useful for the removal of oil-based stains.

The preferred solid particulate cleaning material comprising a multiplicity of polymeric particles which comprise polyamide or polyester particles, most particularly comprise particles of nylon, polyethylene terephthalate or polybutylene terephthalate, or copolymers thereof, most preferably in the form of beads. The polymers may be foamed or unfoamed, and may be linear or crosslinked. Various nylon or polyester homo- or co-polymers may be used including, but not limited to, Nylon 6, Nylon 6,6, polyethylene terephthalate and polybutylene terephthalate. Preferably, the nylon comprises Nylon 6,6 homopolymer having a molecular weight in the region of from 5000 to 30000 Daltons, preferably from 10000 to 20000 Daltons, most preferably from 15000 to 16000 Daltons. The polyester will typically have a molecular weight corresponding to an intrinsic viscosity measurement in the range of from 0.3-1.5 dl/g as measured by a solution technique such as ASTM D-4603.

Optionally, copolymers of the above polymeric materials may be employed for the purposes of the invention. Specifically, the properties of the polymeric materials may be tailored to specific requirements by the inclusion of monomeric units which confer particular properties on the copolymer. Thus, the copolymers may be adapted to attract particular staining materials by including monomer units in the polymer chain which, inter alia, are ionically charged, or include polar moieties or unsaturated organic groups. Examples of such groups may include, for example, acid or amino groups, or salts thereof, or pendant alkenyl groups.

The polymeric particles are of such a shape and size as to allow for good flowability and intimate contact with the soiled substrate, which typically comprises a textile fabric. A variety of shapes of particles can be used, such as cylindrical, spherical or cuboid; appropriate cross-sectional shapes can be employed including, for example, annular ring, dog-bone and circular. Most preferably, however, said particles comprise cylindrical or spherical beads.

The particles may have smooth or irregular surface structures and can be of solid or hollow construction. Particles are of such a size as to have an average mass of 1-35 mg, preferably from 10-30 mg, more preferably from 12-25 mg, and with a surface area of 10-60 $mm^2$, preferably from 20-50 $mm^2$, more preferably from 25-35 $mm^2$.

In the case of cylindrical beads, the preferred particle diameter is in the region of from 1.0 to 6.0 mm, more preferably from 1.5 to 4.0 mm, most preferably from 2.0 to 3.0 mm, and the length of the beads is preferably in the range from 1.0 to 4.0 mm, more preferably from 1.5 to 3.5 mm, and is most preferably in the region of 2.0 to 3.0 mm. Typically, for spherical beads, the preferred diameter of the sphere is in the region of from 1.0 to 6.0 mm, more preferably from 2.0 to 4.5 mm, most preferably from 2.5 to 3.5 mm.

The volume of wash water added to the system is calculated so as to achieve a wash water to fabric ratio which is preferably between 2.5:1 and 0.1:1 w/w; more preferably, the ratio is between 2.0:1 and 0.8:1, with particularly favourable results having been achieved at ratios such as 1.75:1, 1.5:1, 1.2:1 and 1.1:1. Most conveniently, the required amount of water is introduced into the rotatably mounted cylindrical cage of the apparatus after loading of the soiled substrate into said cage. An additional amount of water will migrate into the cage during the circulation of the solid particulate cleaning material, but the amount of carry over is minimised by the action of the separating means.

Whilst, in one embodiment, the method of the invention envisages the cleaning of a soiled substrate by the treatment of the substrate with a formulation which essentially consists only of a multiplicity of polymeric particles and wash water, in the absence of any further additives, in more preferred embodiments the formulation additionally comprises at least one additional cleaning agent. Said at least one cleaning agent preferably comprises at least one detergent composition.

The principal components of the detergent composition comprise cleaning components and post-treatment components. Typically, the cleaning components comprise surfactants, enzymes and bleach, whilst the post-treatment components include, for example, anti-redeposition additives, perfumes and optical brighteners.

However, the detergent formulation may optionally include one or more other additives such as, for example builders, chelating agents, dye transfer inhibiting agents, dispersants, enzyme stabilizers, catalytic materials, bleach activators, polymeric dispersing agents, clay soil removal agents, suds suppressors, dyes, structure elasticizing agents, fabric softeners, starches, carriers, hydrotropes, processing aids and/or pigments.

Examples of suitable surfactants may be selected from non-ionic and/or anionic and/or cationic surfactants and/or ampholytic and/or zwitterionic and/or semi-polar nonionic surfactants. The surfactant is typically present at a level of from about 0.1%, from about 1%, or even from about 5% by weight of the cleaning compositions to about 99.9%, to about 80%, to about 35%, or even to about 30% by weight of the cleaning compositions.

The compositions may include one or more detergent enzymes which provide cleaning performance and/or fabric care benefits. Examples of suitable enzymes include, but are not limited to, hemicellulases, peroxidases, proteases, other cellulases, other xylanases, lipases, phospholipases, esterases, cutinases, pectinases, keratanases, reductases, oxidases, phenoloxidases, lipoxygenases, ligninases, pullulanases, tannases, pentosanases, malanases, [beta]-glucanases, arabinosidases, hyaluronidase, chondroitinase, laccase, and amylases, or mixtures thereof. A typical combination may comprise a mixture of enzymes such as protease, lipase, cutinase and/or cellulase in conjunction with amylase.

Optionally, enzyme stabilisers may also be included amongst the cleaning components. In this regard, enzymes for use in detergents may be stabilised by various techniques, for example by the incorporation of water-soluble sources of calcium and/or magnesium ions in the compositions.

The compositions may include one or more bleach compounds and associated activators. Examples of such bleach compounds include, but are not limited to, peroxygen compounds, including hydrogen peroxide, inorganic peroxy salts, such as perborate, percarbonate, perphosphate, persilicate, and mono persulphate salts (e.g. sodium perborate tetrahydrate and sodium percarbonate), and organic peroxy acids such as peracetic acid, monoperoxyphthalic acid, diperoxydodecanedioic acid, N,N'-terephthaloyl-di(6-aminoperoxycaproic acid), N,N'-phthaloylaminoperoxycaproic acid and amidoperoxyacid. Bleach activators include, but are not limited to, carboxylic acid esters such as tetraacetylethylenediamine and sodium nonanoyloxybenzene sulfonate. Suitable builders may be included in the formulations and these include, but are not limited to, the alkali metal, ammonium and alkanolammonium salts of polyphosphates, alkali metal silicates, alkaline earth and alkali metal carbonates, aluminosilicates, polycarboxylate compounds, ether hydroxypolycarboxylates, copolymers of maleic anhydride with ethylene or vinyl methyl ether, 1,3,5-trihydroxybenzene-2,4,6-trisulphonic acid, and carboxymethyl-oxysuccinic acid, various alkali metal, ammonium and substituted ammonium salts of polyacetic acids such as ethylenediamine tetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

The compositions may also optionally contain one or more copper, iron and/or manganese chelating agents and/or one or more dye transfer inhibiting agents.

Suitable polymeric dye transfer inhibiting agents include, but are not limited to, polyvinylpyrrolidone polymers, polyamine N-oxide polymers, copolymers of N-vinylpyrrolidone and N-vinylimidazole, polyvinyloxazolidones and polyvinylimidazoles or mixtures thereof.

Optionally, the detergent formulations can also contain dispersants. Suitable water-soluble organic materials are the homo- or co-polymeric acids or their salts, in which the polycarboxylic acid may comprise at least two carboxyl radicals separated from each other by not more than two carbon atoms.

Said anti-redeposition additives are physico-chemical in their action and include, for example, materials such as polyethylene glycol, polyacrylates and carboxy methyl cellulose.

Optionally, the compositions may also contain perfumes. Suitable perfumes are generally multi-component organic chemical formulations which can contain alcohols, ketones, aldehydes, esters, ethers and nitrile alkenes, and mixtures thereof. Commercially available compounds offering sufficient substantivity to provide residual fragrance include Galaxolide (1,3,4,6,7,8-hexahydro-4,6,6,7,8,8-hexamethylcyclopenta(g)-2-benZopyran), Lyral (3- and 4-(4-hydroxy-4-methyl-pentyl)cyclohexene-1-carboxaldehyde and Ambroxan ((3aR,5aS,9aS,9bR)-3a,6,6,9a-tetramethyl-2,4,5,5a,7,8,9,9b-octahydro-1H-benZo[e][1]benZofuran). One example of a commercially available fully formulated perfume is AMOUR JAPONAIS supplied by SYMRISE® AG.

Suitable optical brighteners fall into several organic chemical classes, of which the most popular are stilbene derivatives, whilst other suitable classes include benzoxazoles, benzimidazoles, 1,3-diphenyl-2-pyrazolines, coumarins, 1,3,5-triazin-2-yls and naphthalimides. Examples of such compounds include, but are not limited to, 4,4'-bis[[6-anilino-4(methylamino)-1,3,5-triazin-2-yl]amino]stilbene-2,2'-disulfonic acid, 4,4'-bis[[6-anilino-4-[(2-hydroxyethyl)methylamino]-1,3,5-triazin-2-yl]amino]stilbene-2,2'-disulphonic acid, disodium salt, 4,4'-Bis[[2-anilino-4-[bis(2-hydroxyethyl) amino]-1,3,5-triazin-6-yl]amino]stilbene-2,2'-disulfonic acid, disodium salt, 4,4'-bis[(4,6-dianilino-1,3,5-triazin-2-yl) amino]stilbene-2,2'-disulphonic acid, disodium salt, 7-diethylamino-4-methylcoumarin, 4,4'-Bis[(2-anilino-4-morpholino-1,3,5-triazin-6-yl)amino]-2,2'-stilbenedisulfonic acid, disodium salt, and 2,5-bis(benzoxazol-2-yl)thiophene.

Said agents may be used either alone or in any desired combination and may be added to the cleaning system at appropriate stages during the cleaning cycle in order to maximise their effects.

In any event, however, when the method of the invention is performed in the presence of at least one additional cleaning agent, the quantity of said cleaning agent required in order to achieve satisfactory cleaning performance is significantly reduced from the quantities required with the methods of the prior art.

The ratio of solid particulate cleaning material to substrate is generally in the range of from 0.1:1 to 10:1 w/w, preferably in the region of from 0.5:1 to 5:1 w/w, with particularly favourable results being achieved with a ratio of between 1:1 and 3:1 w/w, and especially at around 2:1 w/w. Thus, for example, for the cleaning of 5 g of fabric, 10 g of polymeric particles, optionally coated with surfactant, would be employed in one embodiment of the invention. The ratio of solid particulate cleaning material to substrate is maintained at a substantially constant level throughout the wash cycle.

The method of the present invention may be used for either small or large scale batchwise processes and finds application in both domestic and industrial cleaning processes.

As previously noted, the method of the invention finds particular application in the cleaning of textile fabrics. The conditions employed in such a cleaning system do, however, allow the use of significantly reduced temperatures from those which typically apply to the conventional wet cleaning of textile fabrics and, as a consequence, offer significant environmental and economic benefits. Thus, typical procedures and conditions for the wash cycle require that fabrics are generally treated according to the method of the invention at, for example, temperatures of between 5 and 95° C. for a duration of between 5 and 120 minutes in a substantially sealed system. Thereafter, additional time is required for the completion of the rinsing and bead separation stages of the overall process, so that the total duration of the entire cycle is typically in the region of 1 hour.

The cycle for removal of solid particulate material after removal of the sealing means from the cylindrical cage may optionally be performed at room temperature and it has been established that optimum results are achieved at cycle times of between 2 and 30 minutes, preferably between 5 and 20 minutes.

The results obtained are very much in line with those observed when carrying out conventional wet (or dry) cleaning procedures with textile fabrics. The extent of cleaning and stain removal achieved with fabrics treated by the method of the invention is seen to be very good, with particularly outstanding results being achieved in respect of hydrophobic stains and aqueous stains and soiling, which are often difficult to remove. The energy requirement, the total volume of water used, and the detergent consumption of the method of the invention are all significantly lower than those levels associated with the use of conventional aqueous washing procedures, again offering significant advantages in terms of cost and environmental benefits.

Additionally, it has been demonstrated that re-utilisation of the polymer particles is possible, allowing for the performance of multiple washes with the same solid particulate cleaning material. Re-use of the particles in this way for repeat cleaning procedures provides significant economic benefits and the achievement of satisfactory results after multiple washes is assisted by the nature of the process, which relies on continuous cleaning of the particulate cleaning material as an integral part of the procedure, although it generally found that some deterioration in performance is eventually observed.

Referring to the Figures provided herewith, there is seen in FIG. 1 an apparatus according to the invention comprising housing means (1) having a first upper chamber having mounted therein a rotatably mounted cylindrical cage in the form of perforated drum (5) and a second lower chamber comprising enlarged sump (2) located beneath said cylindrical cage. The apparatus additionally comprises, as first recirculation means, bead and water riser pipe (9) which feeds into bead separation vessel (10), including filter material (10*a*), typically in the form of a wire mesh, and bead release gate valve (12) which feeds into bead delivery tube (13) mounted in fixed drum entry (14). The first recirculation means is driven by bead pump (7). Additional recirculation means comprises return water pipe (11), which allows water to return from the separation vessel (10) to the sump (2) under the influence of gravity. The apparatus also comprises access means shown as loading door (16), though which material for cleaning may be loaded into drum (5). Multiple delivery means are provided in the form of cold water feed port (15) located in fixed drum entry (14), and detergent port (17); additional cleaning agents are most conveniently introduced through port (15). The inner surface of the cylindrical side walls of the rotatably mounted cylindrical cage (5) includes a multiplicity of spaced apart elongated protrusions in the form of lifters (6) which comprise air amplifiers (6*a*) which are driven pneumatically to cause a current of air to circulate within the drum (5) and aid the separation of the solid particulate cleaning material from the wash load. The outer surface of said drum is fitted with removable sealing means in the form of removable flexible skin (5*a*) which may be applied to, or removed from, the cage (5) via the housing aperture (19). The solid particulate cleaning material, comprising polymer beads (3), is initially present in enlarged sump (2), which is equipped with water pump (8), water recirculation pipe (8*a*), heater pads (4) (affixed to the outer surface of the sump) and temperature probe (18) to ensure that efficient and uniform heating of the cleaning material to the desired temperature is achieved. In alternative embodiments, heater rods may be included within the sump (2) as an alternative or additional heating means.

Figure 2B:
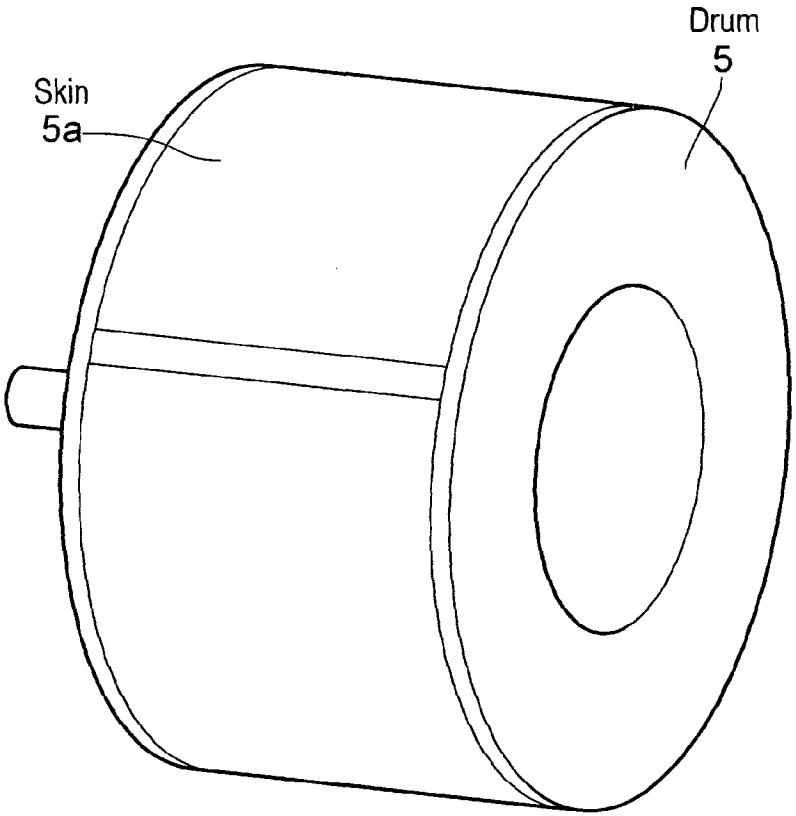
FIG. 2(*a*) illustrates the aperture in the housing means which provides access to the rotatably mounted cylindrical cage for attachment and removal of the sealing means.
Figure 2A:
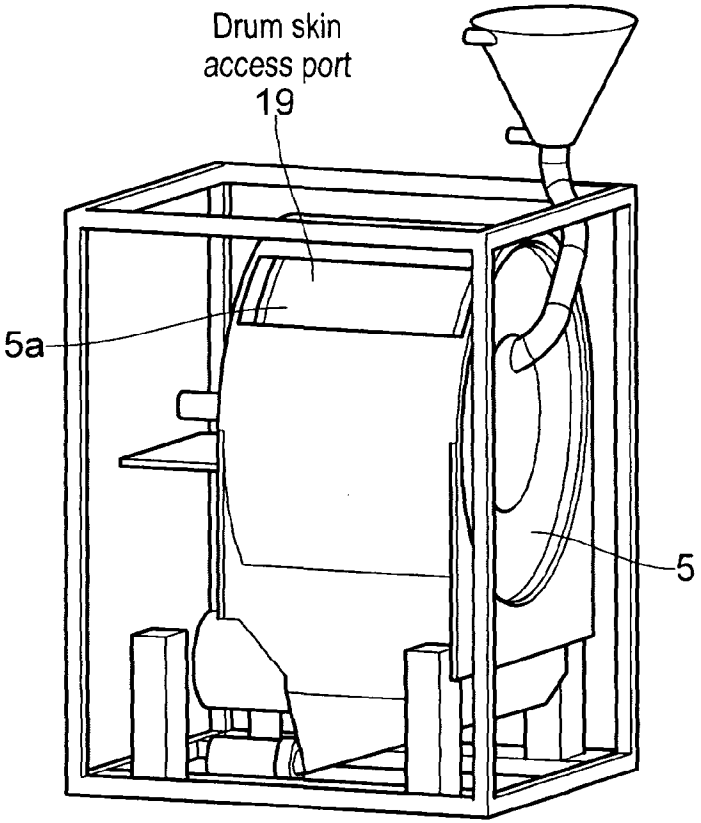

In FIG. 2(*a*), there is provided a clearer view of the housing aperture (19) which provides access to the outer surface of the drum (5) to allow for attachment and removal of the sealing means (5*a*), whilst FIG. 2(*b*) depicts the sealing means (5*a*) completely attached to the outer surface of the drum (5).

Figures 3A, 3B:
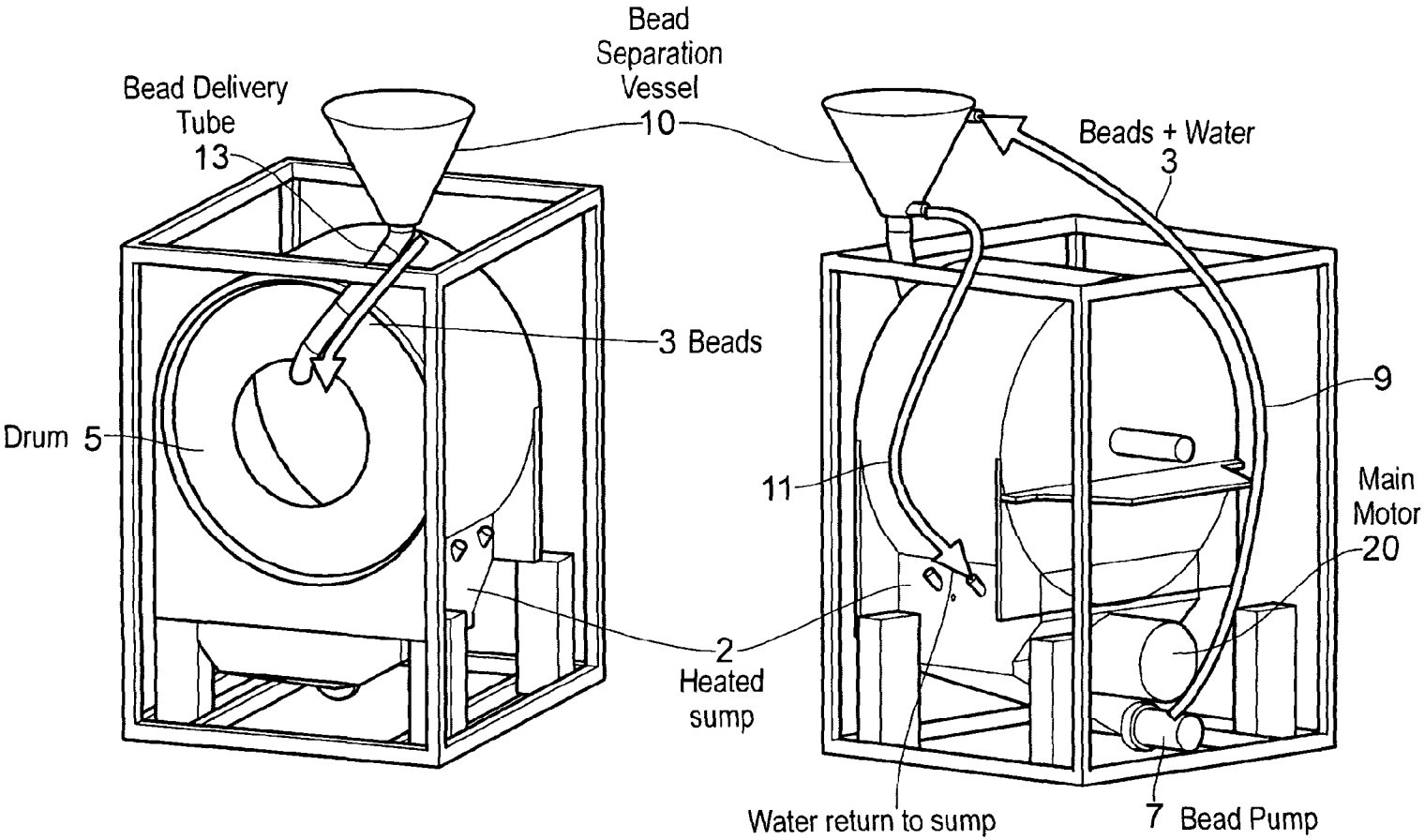
FIGS. 3(*a*) and (*b*) show aspects of the recirculation means of the apparatus according to the invention.
Figure 4A:
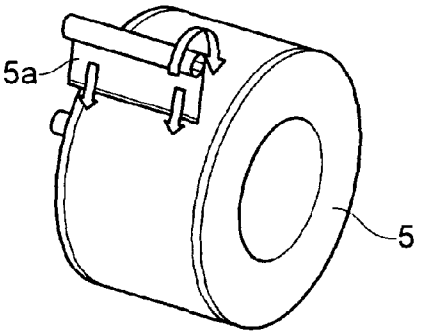
FIGS. 4(*a*)-(*f*) illustrate the attachment of the sealing means to the rotatably mounted cylindrical cage.
Figure 4B:
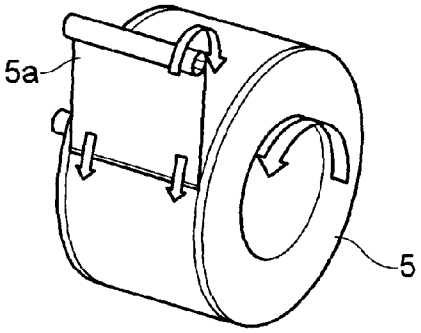
Figure 4C:
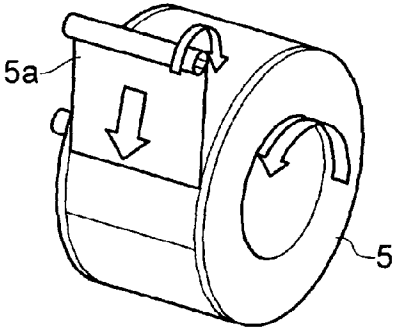
Figure 4D:
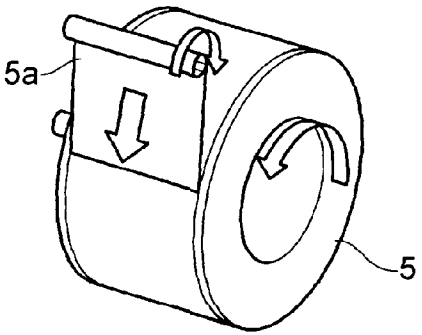
Figure 4E:
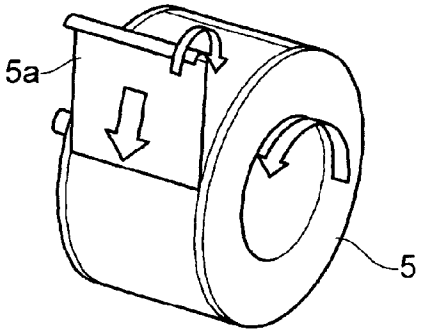
Figure 4F:
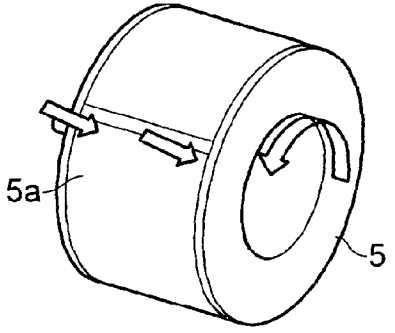
Figure 5A:
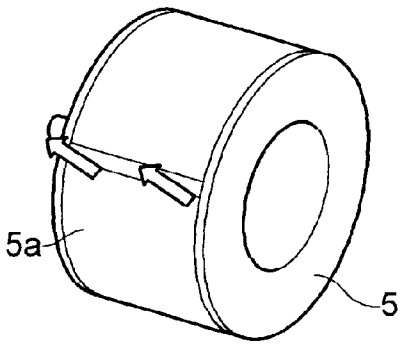
FIGS. 5(*a*)-(*f*) depict the removal of the sealing means from the rotatably mounted cylindrical cage.
Figure 5B:
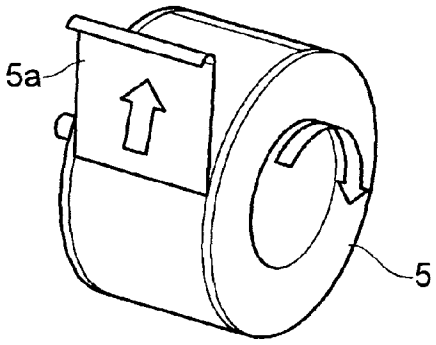
Figure 5C:
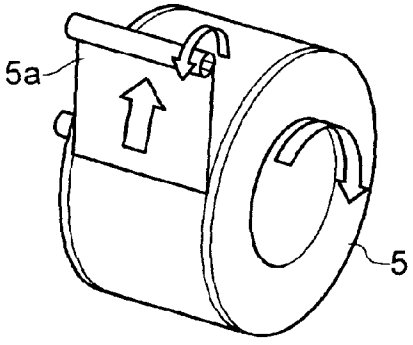
Figure 5D:
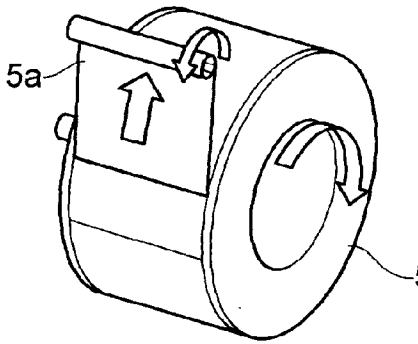
Figure 5E:
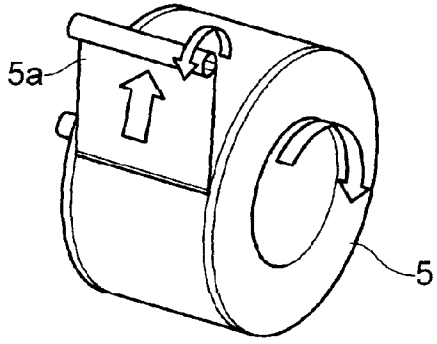
Figure 5F:
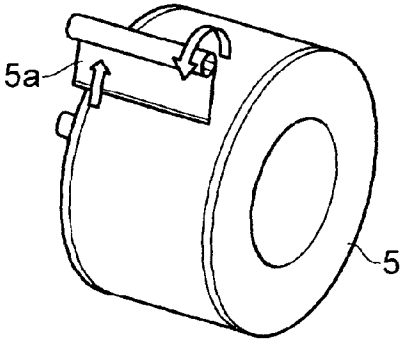

FIG. 3(*a*) illustrates a section of the first recirculation system, wherein the solid particulate cleaning material in the form of beads (3) passes from the bead separation vessel (10) through the bead delivery tube (13) and into the rotatably mounted cylindrical drum (5), and FIG. 3(*b*) shows other sections of the first recirculation system, wherein the solid particulate cleaning material comprising beads (3) and water is driven by bead pump (7) from the heated sump (2) through the bead and water riser pipe (9) to the bead separation vessel (10), from which separated water returns to the sump via return water pipe (11) under the influence of gravity. The main motor (20) of the apparatus, responsible for driving the rotatably mounted cylindrical drum (5), is also depicted.

FIGS. 4(*a*)-(*f*) show the stages involved in the manual attachment of the sealing means (5*a*) to the rotatably mounted cylindrical cage (5), wherein the leading edge of skin (5*a*) is first extended towards the drum, and then engages with the drum. Thereafter, the drum rotates and pulls the skin onto its surface and continues rotating until the trailing edge of the skin engages with the surface of the drum, such that it is held in place, preferably by means of hooks and/or tie bars and/or tensioning clips.

FIGS. 5(*a*)-(*f*) illustrate the stages involved in the manual removal of the sealing means (5*b*) from the rotatably mounted cylindrical cage (5), wherein the trailing edge of the skin is initially released from the drum and engaged with a rewind mechanism, whereupon the skin may be rewound onto a spool as the drum is rotated until such time as the leading edge of the skin is released from the drum, and may then be fully retracted clear of the drum.

Thus, in operation, the enlarged sump (2), together with its contents (water and polymer beads (3)) may be heated by heater pads (4) attached to the outer surface of the sump (2). The bead pump (7) pumps the beads (3) and water up through the riser pipe (9) to the bead separation vessel (10) where the beads (3) are temporarily retained within the vessel (10) whilst the drained water returns to the sump via a return pipe (11). The rigid filter material (10*a*) within the vessel (10) allows the water carried with the beads to escape from within the mass of the beads, whilst the gate valve (12) retains the beads (3) within the vessel (10). Thus, the water drains from the vessel (10) and returns to the sump (2). When the valve (12) is opened, the beads (3) pass through the valve (12) and travel down the bead delivery tube (13), through the fixed drum entry (14) and in to the drum (5). Cold water and additional cleaning agent may be added to the contents of the drum (5) via the cold water feed port (15) located in fixed drum entry (14). The wash load is placed into the drum (5) through openable loading door (16), and detergent is added to the system via port (17) in the sump (2), or via the cold water feed port (15). The system temperature is monitored via temperature probe (18) mounted in the sump (2), whilst 'water' pump (8) circulates water around the sump via pipe (8*a*).

Hence, the system provides a means of adding polymer beads to a wash load, performing the washing cycle, and then separating the beads from the wash load once the washing cycle is complete. The process of adding and removing the polymer beads to the wash relies upon the use of the flexible sealing means, illustrated as the flexible skin (5*a*), to seal perforations in the surface of the drum. With the skin in place, the outer surface of the drum is sealed and the wash, beads and wash water can be retained within the drum during the washing process. However, when the skin is removed, perforations in the outer surface of the drum allow the polymer beads to pass from the inside of the drum and return to the sump. The process may be conveniently illustrated by describing one complete wash cycle.

Thus, the skin (5*a*) is attached to the drum (5) through an aperture in the machine housing (19), thereby sealing the drum. The polymer beads (3) together with the required addition of water to achieve the correct ratio are heated to operating temperature in the sump (2) by the sump heater pads (4), and the water is recirculated through the beads using the water pump (8) to ensure that a uniform bulk temperature is achieved. Once the required operating temperature is achieved, the wash load is placed into the drum (5) and the loading door (16) is closed. Initially, cold water and any additional cleaning agent are added to the wash load via the cold water feed port (15) to ensure that any stains (such as egg) are not 'baked' on to the fabric when the warm wash water and beads (3) are introduced. The wash load is agitated gently to disperse the cold water evenly amongst the load and fully wet out the cloth.

Once the temperature probe (18) indicates that the working temperature has been reached by the beads and water within the sump, the bead pump (7) pumps a mixture of beads (3) and water up to the bead separation vessel (10). Excess water is allowed to drain back to the sump (2) and the valve (12) is then opened to release the beads into the drum (5) via the bead delivery tube (13). This operation is repeated a number of times until the required quantity of beads (3) have been delivered to the drum (5). Optionally, additional cleaning agent may be added to the apparatus via the bead addition process.

The system then performs a wash cycle in a similar manner to a standard washing machine with the drum rotating at between 20 rpm and 60 rpm for several revolutions in one direction, then rotating a similar number of rotations in the opposite direction. This sequence is repeated for up to 60 minutes. On completion of this wash cycle, the machine pauses to allow the removal of the skin (5*a*) from the drum via the aperture (19) in the machine housing.

With the skin (5*a*) removed, the drum is no longer sealed, so that the beads (3) are no longer retained within the drum (5) and are free to fall through the drum perforations and out into the sump. A series of slow speed rotations and counter rotations is now performed to encourage the beads (3) to fall through the perforations in the drum (5) and return to the sump (2). In order to release beads trapped in between the fabric pieces the drum (5) may be rotated more quickly, thereby causing the fabric to be thrown outwards against the inner surface of the drum. This action also aids the removal of excess liquid from the fabric. When the rotation of the drum (5) slows again, the fabric pieces fall away from the inner surface of the drum and reorientate themselves within the drum cavity, thus helping to release beads trapped between the fabric pieces. The series of slow speed 'tumbling' rotations is then repeated. This entire sequence is repeated a number of times until virtually all of the beads (3) have been removed from within the drum (5). At any point during this bead separation sequence, air can be blown into the drum through the air amplifiers (6*a*) within the lifters (6) to disrupt and cause the billowing of the cloth to aid bead removal. The wash load can then be removed from the drum (5) via the loading door (16).

In a separate optional step, the wash load may be rinsed with water following the wash cycle. Optionally, this rinsing operation and the bead removal operation following removal of the skin may be performed at higher cage rotation speeds.

In further optional stages, following their removal from the drum and transfer to the sump, the beads may be cleaned by sluicing the sump with clan water in the presence or absence of a cleaning agent, such as a surfactant. Alternatively, cleaning of the beads may be carried out by washing them alone in the drum following removal of the wash load.

The invention will now be further illustrated, though without in any way limiting the scope thereof, by reference to the following examples and associated illustrations.

EXAMPLES

Example 1

Woven cotton fabric (194 $gm^{-2}$, Whaleys, Bradford, U.K.) was stained with coffee, lipstick, ball point pen, tomato ketchup, boot polish, grass, vacuum dirt, curry sauce and red wine following the methods described below:

(i) Coffee 10 g of MORRISONS® FULL ROAST coffee powder was dissolved in 50 ml distilled water at 70° C. A 1 $cm^3$ aliquot of the ensuing solution was applied to the fabric using a synthetic sponge, within the confines of a 5 cm diameter circular plastic template; the stained fabric was then allowed to dry at ambient temperature (23° C.), after which the fabric was aged prior to use, by storage in the dark for 4 days.

(ii) Lipstick

REVLON® SUPER LUSTROUS lipstick (copper frost shade) was applied to the fabric using a synthetic sponge to provide a uniform coverage within the confines of a 5 cm diameter circular plastic template. The fabric was then aged following the procedure recounted for coffee.

(iii) Ball Point Pen

A black PAPER MATE® FLEX GRIP ULTRA ball point pen was used to uniformly cover the fabric within the confines of a 5 cm diameter circular plastic template. The fabric was then aged following the procedure recounted for coffee.

(iv) Tomato Ketchup

HEINZ® tomato ketchup was applied to the fabric using a synthetic sponge to provide a uniform coverage within the confines of a 5 cm diameter circular plastic template. The fabric was then aged following the procedure recounted for coffee.

(v) Boot Polish

KIWI® black boot polish was applied to the fabric using a synthetic sponge to provide a uniform coverage within the confines of a 5 cm diameter circular plastic template. The fabric was then aged following the procedure recounted for coffee.

(vi) Grass

Grass was collected manually from an MG7 (National Vegetation Classification) source. 10 g of the grass was chopped with scissors and blended with 200 ml of tap water using an electronic blender. The mixture was then filtered using a metal sieve, and the filtrate used as the staining medium. This was applied to the fabric using a synthetic sponge to provide a uniform coverage within the confines of a 5 cm diameter circular plastic template. The fabric was then aged following the procedure recounted for coffee.

(vii) Vacuum Dirt

Vacuum dirt was collected manually from a general domestic vacuum bag. 25 g of vacuum dirt was mixed with 100 ml of tap water, and the mixture used to stain the fabric. This was applied to the fabric using a synthetic sponge to provide a uniform coverage within the confines of a 5 cm diameter circular plastic template. The fabric was then aged following the procedure recounted for coffee.

(viii) Curry Sauce

MORRISONS® own brand curry sauce was applied directly to the fabric using a synthetic sponge to provide a uniform coverage within the confines of a 5 cm diameter circular plastic template. The fabric was then aged following the procedure recounted for coffee.

(ix) Red Wine

"SPANISH RED WINE" purchased at MORRISONS® was applied directly to the fabric using a synthetic sponge to provide a uniform coverage within the confines of a 5 cm diameter circular plastic template. The fabric was then aged following the procedure recounted for coffee.

Figure 6:
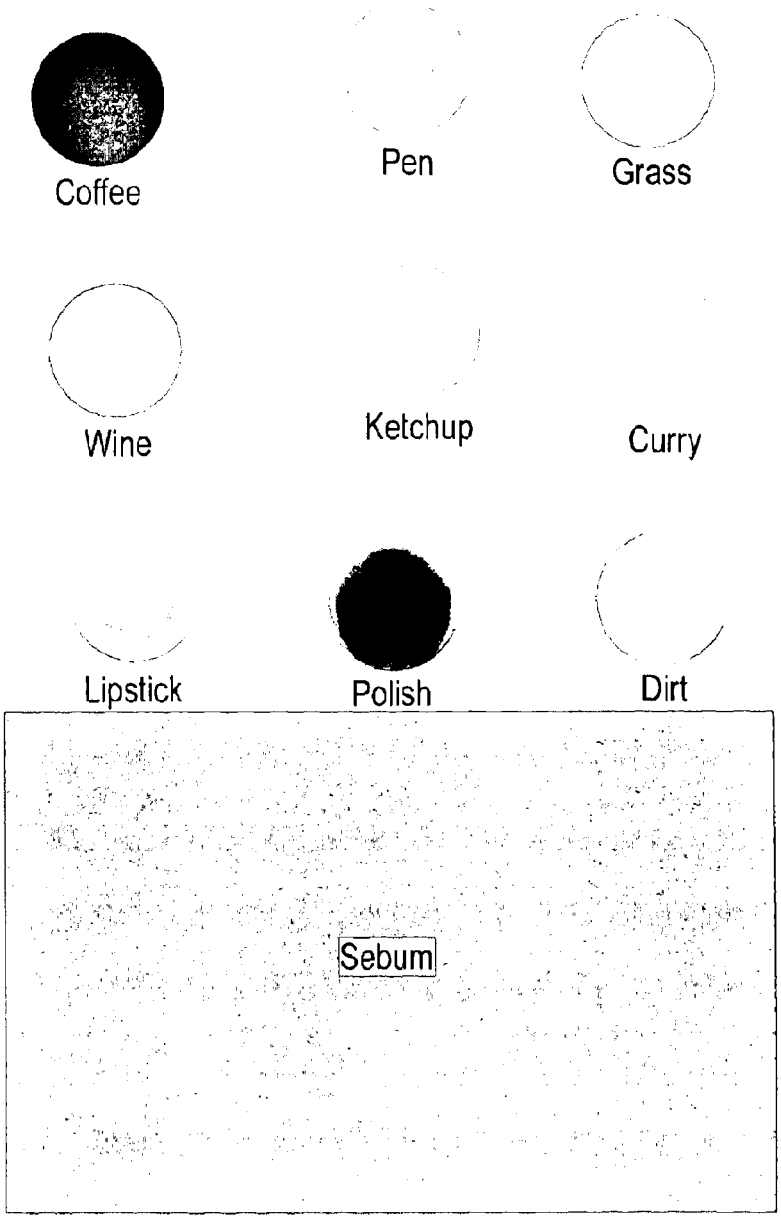
FIG. 6 shows a standard stain set utilised for cleaning trials carried out in the apparatus of the invention.

Each of the stains (i)-(ix) was applied to a single (36 cm×30 cm) piece of cotton fabric in the pattern shown in FIG. 6, in order to make up a standard stain set.

Cleaning trials were then carried out using a set of trial and control conditions, as set out in Table 1. The trials involved the use of a preferred apparatus as hereinbefore defined according to the method of the invention ("Xerosi Skin On" XP 1), whilst control cleaning trials were carried out using a standard domestic washing machine (BEKO® WM5120W, XP2). In both cases (XP1 & XP2) the standard stain sets were added at 1/kg of washload, and a simulated sebum grease stain of 10 g/kg of washload was also incorporated as impregnated cotton cloth (WFK). This cloth is used to better simulate the domestic washing environment where such collar and cuff grease is the dominant stain (making up 80% of the overall stain loading). Sebum is derived from the skin's sebaceous glands. The XP1 process was undertaken with a 24 kg cotton fabric washload, 28.8 liters of wash water (i.e. 1.2 liters/kg washload) and 96 kg of INVISTAT™ 1101 polyester beads (i.e. 4.0 kg/kg washload). After the wash was completed in the sealed drum, and the seal removed, a rinse cycle was employed to finish the cleaning process. The detergent used was UNILEVER PERSIL SMALL & MIGHTY® biological liquid at 3.7 g/kg of washload for both XP1 & XP2. The test parameters are summarised in Table 1.

TABLE 1

XP1 & XP2 Wash Test Details

| Test # | Machine Type | Washload (kg) | Detergent Dosage (g) | Detergent Dosage (g/kg) | Water Consumption (litres/kg) | Wash Temperature (° C.) | Cycle Time (mins) |
|---|---|---|---|---|---|---|---|
| XP1 (Trial) | Xeros Preferred | 24 | 89 | 3.7 | 4.2 | 15 | 85 |
| XP2 (Control) | BEKO WM5120W | 4 | 15 | 3.7 | 14.0 | 40 | 127 |

The domestic control (XP2) was carried out with a 4 kg washload, even though the BEKO WM5120W is rated as a 5 kg machine. This is the widely accepted average washload size for the European domestic market and it, in turn, makes this control more rigorous. The increased ullage in the drum results in more mechanical action and a better wash performance. It should also be noted that XP2 was run at a higher wash temperature (40° C.), and with increased water consumption (14.0 liters/kg); in addition, the XP2 cycle time was considerably longer than with the process according to the invention. All of these parameters were a function of the cycle chosen on the machine (40° C., cotton), and they also increased the rigour of the control.

Figure 7:
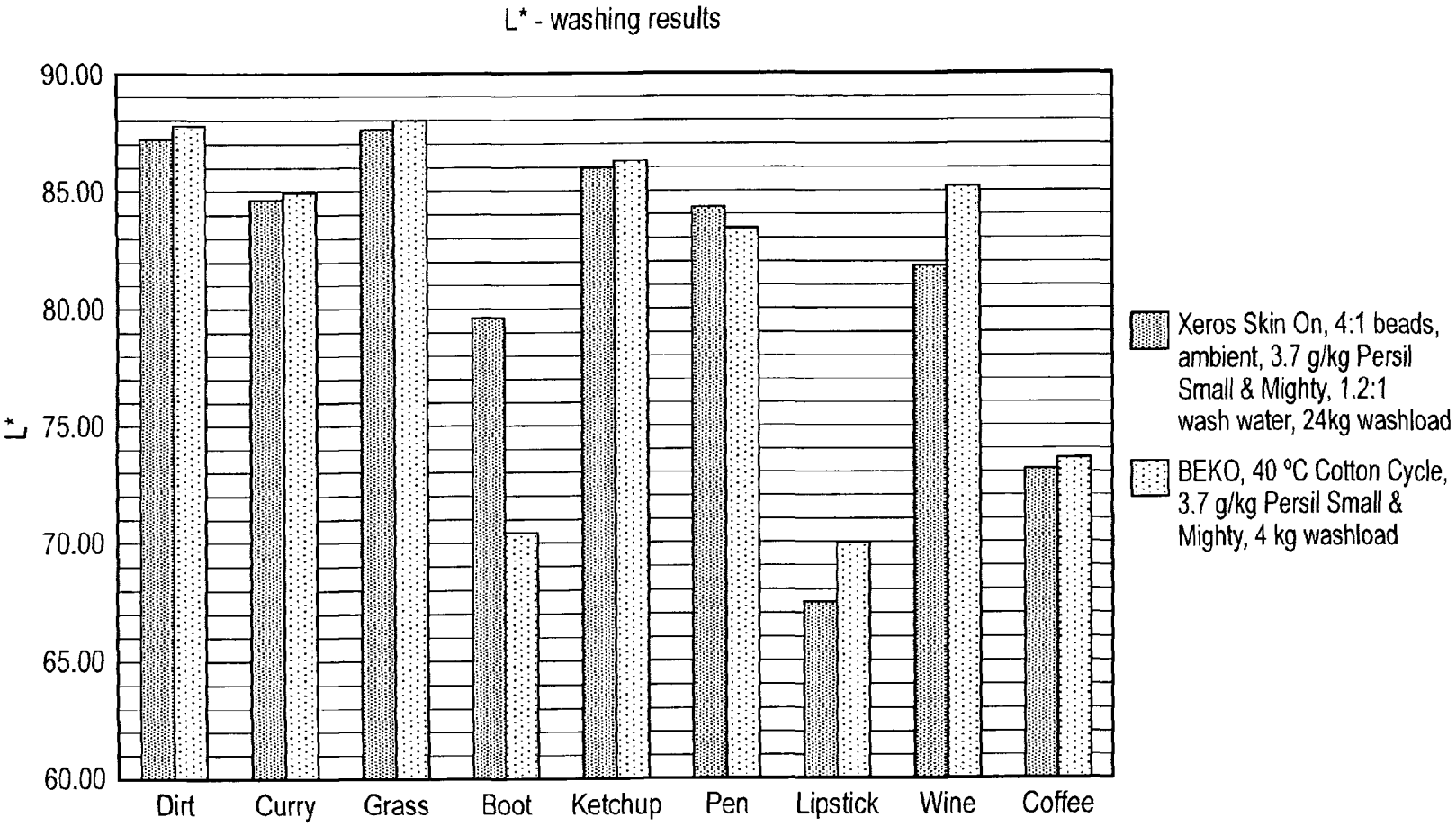
FIG. 7 is a bar chart illustrating CIE L* colour co-ordinate values for the various stains after cleaning trials using the apparatus of the invention, which illustrate the efficiency of the cleaning process.
Figure 8:
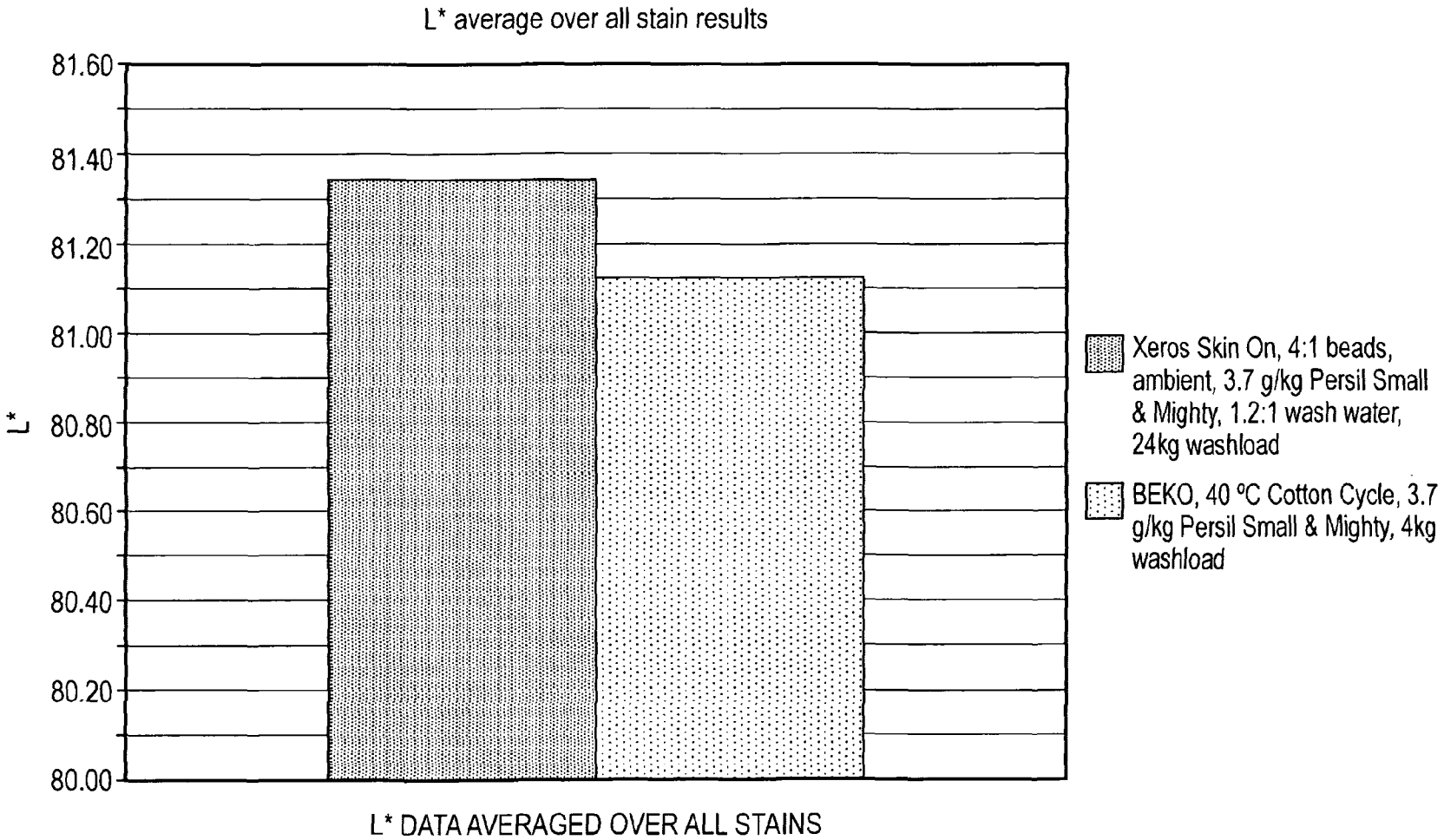
FIG. 8 shows the CIE L* colour co-ordinate data of FIG. 7 when averaged across all stains.

The level of cleaning achieved was assessed using colour measurement. Reflectance values of samples were measured using a DATACOLOR SPECTRAFLASH SF600 spectrophotometer interfaced to a personal computer, employing a 10° standard observer, under illuminant $D_{65}$, with the UV component included and specular component excluded; a 3 cm viewing aperture was used. Measurements using a single thickness of fabric were made. The CIEL* colour co-ordinate was taken in each case and these results are set out in FIGS. 7 and 8, with higher values indicating better cleaning performance. Comparison of XP1 with XP2 shows the cleaning process carried out in the apparatus of the invention gave parity performance (within 1 L* unit) for removal of the vacuum dirt, curry sauce, grass, tomato ketchup, ball point pen and coffee stains, and superior performance (>1 L* unit difference) for the boot polish stain. The process using the apparatus of the invention was not as good as the domestic control for the lip stick and red wine stains. Overall, however, XP1 showed parity cleaning performance with XP2 when the results from all nine stains were averaged, as shown in FIG. 8. This result was achieved despite the wash temperature increase required with XP2, as well as its increased water consumption/kg of washload, and substantially longer cycle time (see Table 1).

Example 2

The XP1 wash test from Example 1 was repeated and compared to an ambient temperature control wash in the BEKO WM5120W (XP3). The BEKO WM5120W machine does not have an ambient wash cycle and, therefore, the 40° C. cotton cycle was again selected, but the machine heater was disabled so that an ambient wash could be performed. The same washload make up was employed as in Example 1 for XP3 in terms of stain set and sebum cloth addition. For this control, however, the detergent dosage used was significantly increased, as set out in Table 2. The sebum cloths were examined here, as these are notoriously difficult to clean at low (<40° C.) wash temperatures, and such grease removal is a key goal of the laundry industry. These cloths start out dark grey in colour in their unwashed state (see FIG. 6).

TABLE 2

XP1 & XP3 Wash Test Details

| Test # | Machine Type | Washload (kg) | Detergent Dosage (g) | Detergent Dosage (g/kg) | Water Consumption (litres/kg) | Wash Temperature (° C.) | Cycle Time (mins) |
|---|---|---|---|---|---|---|---|
| XP1 (Trial) | Xeros Preferred | 24 | 89 | 3.7 | 4.2 | 15 | 85 |
| XP3 (Control) | BEKO WM5120W | 4 | 37 | 9.3 | 14.0 | 15 | 127 |

Figure 9:
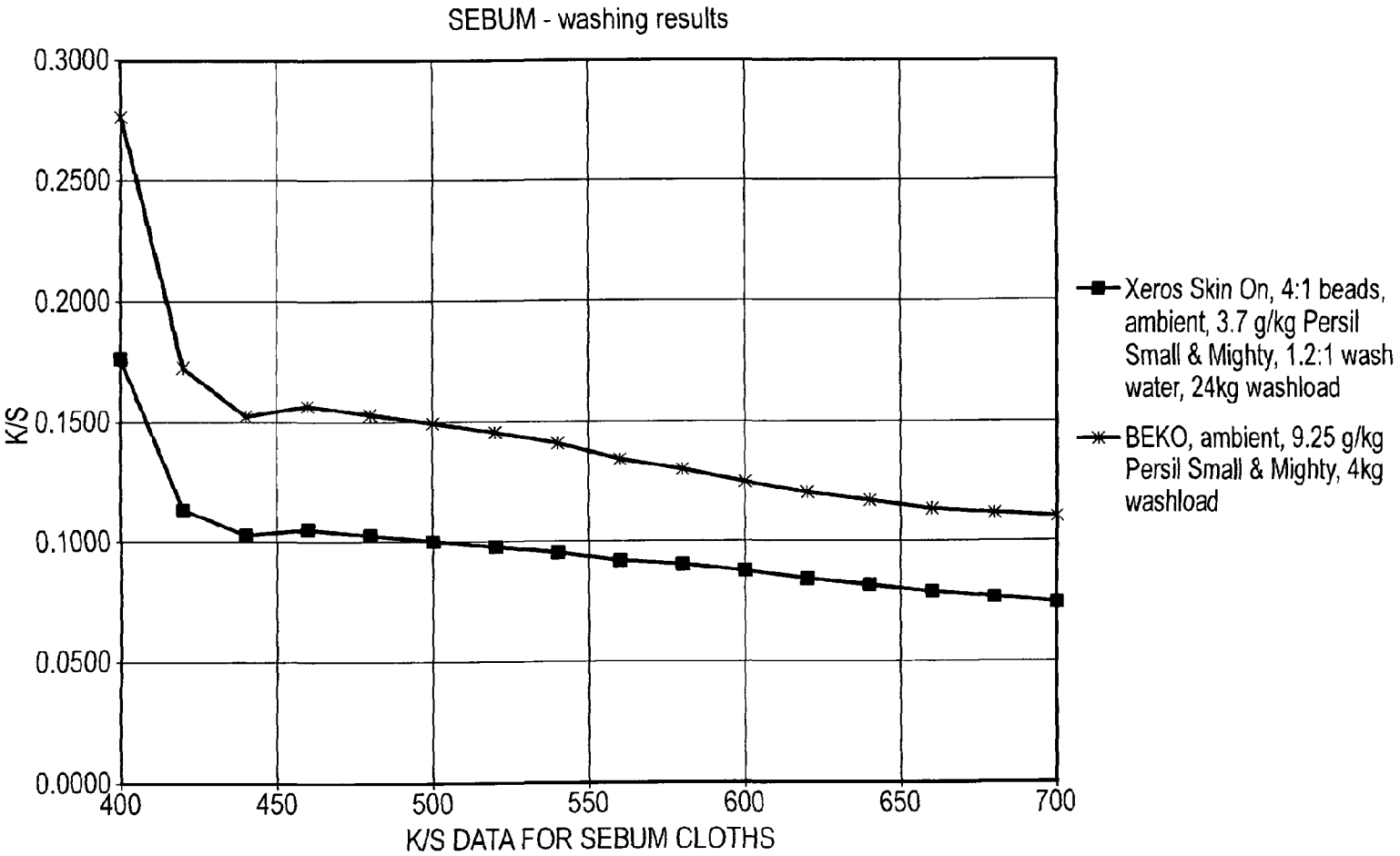
FIG. 9 illustrates the efficiency of cleaning of sebum cloth in an apparatus according to the invention as measured in terms of colour strength (K/S) values.

The level of cleaning achieved was again assessed using colour measurement. Reflectance values of samples were measured using a DATACOLOR SPECTRAFLASH SF600 spectrophotometer interfaced to a personal computer, employing a 10° standard observer, under illuminant $D_{65}$, with the UV component included and specular component excluded; a 3 cm viewing aperture was used. Measurements using a single thickness of fabric were made. The reflectance measured as a function of wavelength was used to determine the colour strength values (K/S) Which are shown in FIG. 9. Hence, on this occasion, lower values indicate better cleaning Comparison of XP1 with XP3 shows the process carried out in the apparatus according to the invention gives superior performance across the 400-700 nm visible wavelength range, i.e. sebum stains can be better cleaned by the process of the invention. This achievement is despite the detergent dosage increase with XP3, as well as its increased water consumption/kg of washload, and substantially longer cycle time (see Table 2).

Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

The invention claimed is:

1. An apparatus for use in the cleaning of soiled substrates, said apparatus comprising:

(a) housing means, having:

(i) a first upper chamber having mounted therein a rotatably mounted cylindrical cage, and (ii) a second lower chamber located beneath said cylindrical cage;

(b) at least one recirculation means, wherein said at least one recirculation means optionally comprises pumping means;

(c) access means;

(d) a multiplicity of delivery means; and (e) sealing means, wherein said rotatably mounted cylindrical cage comprises a plurality of perforations in its cylindrical side walls, thereby allowing for ingress and egress of fluids, fine particulate materials and discrete particulate materials, wherein said sealing means is removably attached to the surface of the cylindrical side walls of said rotatably mounted cylindrical cage, and is adapted to prevent the ingress or egress of fluids and solid particulate matter from the interior of said cage by covering said perforations, wherein said cage optionally comprises a cylinder with a diameter in the region of 75 to 120 cm and an optional length of between 40 and 100 cm.

2. An apparatus as claimed in claim 1 wherein said access means is closable so as to provide a substantially sealed system, and said access means optionally comprises a hinged door mounted in the casing.

3. An apparatus as claimed in claim 1 wherein said perforations optionally have a diameter of from 2 to 25 mm.

4. An apparatus as claimed in claim 1 wherein rotation of said rotatably mounted cylindrical cage is effected by use of drive means, wherein operation of said drive means is effected by control means.

5. An apparatus as claimed in claim 1 which comprises agitating means, wherein said agitating means optionally comprises an air jet.

6. An apparatus as claimed in claim 1 wherein said second lower chamber functions as a collection chamber for cleaning media and comprises an enlarged sump and optionally comprises additional pumping means to promote circulation and mixing of the contents thereof.

7. An apparatus as claimed in claim 1 which includes a second recirculation means, wherein said second recirculation means optionally allows for the return of water separated by said separating means to said lower chamber.

8. An apparatus as claimed in claim 1 wherein said housing means comprises an aperture which provides access to the outer surface of said cylindrical cage.

9. An apparatus as claimed in claim 1 wherein said sealing means comprises either:

(a) a flexible polymeric sheet of material which is either:
  (i) removably attached to the outer surface of the cylindrical side walls of said rotatably mounted cylindrical cage by fixing means, wherein said fixing means is optionally selected from hooks, tie bars and tensioning clips; or
  (ii) removably attached to the outer surface of the cylindrical side walls of said rotatably mounted cylindrical cage by vacuum means, or
(b) covers which are attached slideably or via a hinged mechanism to the inner or outer surface of said cylindrical cage and may be moved from a first position, covering said perforations, to a second position, wherein said perforations are opened to allow ingress and egress of materials to and from said cylindrical cage.

10. An apparatus as claimed in claim 1 which comprises circulation means and wherein the inner surface of the cylindrical side walls of said rotatably mounted cylindrical cage optionally comprises circulation means comprising a multiplicity of spaced apart elongated protrusions affixed essentially perpendicularly to said inner surface.

11. An apparatus as claimed in claim 10 wherein said protrusions additionally comprise air amplifiers which are optionally driven pneumatically and are adapted so as to promote circulation of a current of air within said cage.

12. An apparatus as claimed in claim 1 wherein said at least one recirculation means facilitates recirculation of said solid particulate material from said lower chamber to said rotatably mounted cylindrical cage for re-use in cleaning operations and comprises ducting connecting said second chamber and said rotatably mounted cylindrical cage.

13. An apparatus as claimed in claim 12 wherein said ducting comprises separating means for separating said solid particulate material from water, wherein said separating means optionally comprises a vessel located above said cylindrical cage and said vessel optionally comprises a filter material.

14. An apparatus as claimed in claim 12 wherein said ducting comprises control means, adapted to control entry of said solid particulate material into said cylindrical cage, wherein said control means optionally comprises a valve located in feeder means connected to the interior of the cylindrical cage and said feeder means optionally comprises a feed tube.

15. A method for cleaning a soiled substrate, said method comprising the treatment of the substrate with a formulation comprising solid particulate cleaning material and wash water, wherein said method is carried out in an apparatus according to claim 1.

16. A method as claimed in claim 15 wherein said at least one soiled substrate comprises at least one textile fibre garment, and said method is optionally carried out at a wash water to substrate ratio of between 2.5:1 and 0.1:1 w/w.

17. A method as claimed in claim 15 wherein said solid particulate cleaning material comprises a multiplicity of polymeric particles, wherein said polymeric particles optionally comprise particles of polyamides, polyesters, polyalkenes or polyurethanes or their copolymers, and wherein the ratio of solid particulate cleaning material to substrate is optionally in the range of from 0.1:1 to 10:1 w/w.

18. A method as claimed in claim 15 wherein at least one additional cleaning additive is employed, and said at least one additional cleaning additive optionally comprises a detergent composition comprising cleaning components and post-treatment components.

19. A method for cleaning a soiled substrate, said method comprising the steps of:

(a) attaching sealing means to the outer surface of a rotatably mounted cylindrical cage of an apparatus according to claim 1;
(b) introducing a solid particulate cleaning material and wash water into the second lower chamber of said apparatus;
(c) agitating and heating said solid particulate cleaning material and water;
(d) loading at least one soiled substrate into said rotatably mounted cylindrical cage via access means;
(e) closing the access means so as to provide a substantially sealed system;
(f) introducing said solid particulate cleaning material and water into said rotatably mounted cylindrical cage via recirculating means;
(g) operating the apparatus for a first (wash) cycle, wherein said rotatably mounted cylindrical is caused to rotate;
(h) removing said sealing means from the outer surface of said rotatably mounted cylindrical cage;
(i) operating the apparatus for a second cycle, wherein fluids and solid particulate cleaning material are caused to fall through perforations in said rotatably mounted cylindrical cage into said second lower chamber;
(j) repeating steps (a), (c) and (f) to (i) as required; and
(k) removing the cleaned at least one substrate from the apparatus, wherein said second cycle optionally comprises a rinsing operation wherein additional water is added to said rotatably mounted cylindrical cage.

20. A method as claimed in claim 19 wherein said solid particulate cleaning material is re-used for multiple washes and is optionally subjected to a cleaning operation in said lower chamber by sluicing said chamber with clean water or is subjected to a cleaning operation in said rotatably mounted cylindrical cage.

* * * * *